US009255576B2

(12) United States Patent
Adams et al.

(10) Patent No.: US 9,255,576 B2
(45) Date of Patent: Feb. 9, 2016

(54) CUTTER APPARATUS FOR CENTRIFUGAL PUMP

(75) Inventors: John D. Adams, Tualatin, OR (US); Frank D. Timmons, Battle Ground, WA (US); James C. Garvin, Gresham, OR (US); Steve J. Schoenbrun, Sherwood, OR (US)

(73) Assignee: Cornell Pump Company, Clackamas, OR (US)

( * ) Notice: Subject to any disclaimer, the term of this patent is extended or adjusted under 35 U.S.C. 154(b) by 782 days.

(21) Appl. No.: 13/601,017

(22) Filed: Aug. 31, 2012

(65) Prior Publication Data

US 2014/0064929 A1 Mar. 6, 2014

(51) Int. Cl.
*F04D 7/04* (2006.01)

(52) U.S. Cl.
CPC ..... *F04D 7/045* (2013.01)

(58) Field of Classification Search
CPC ..... F04D 7/02; F04D 7/04; F04D 7/045; F04D 29/2288; F04D 29/2294; F04D 22/285; F04D 22/282; F04D 29/4213
See application file for complete search history.

(56) References Cited

U.S. PATENT DOCUMENTS 3,726,486 A * 4/1973 Smith et al. ..... 241/46.11
4,402,648 A * 9/1983 Kretschmer ..... 415/121.1
4,913,619 A * 4/1990 Haentjens et al. ..... 415/172.1
5,016,825 A * 5/1991 Carpenter ..... 241/46.06
5,456,580 A * 10/1995 Dorsch ..... 416/223 B
7,125,221 B2 * 10/2006 Dorsch et al. ..... 415/121.1
7,159,806 B1 1/2007 Ritsema
7,237,736 B1 * 7/2007 Martin ..... 241/46.06
7,520,454 B2 * 4/2009 Zelder et al. ..... 241/46.06
7,607,884 B2 10/2009 Cohen
7,841,550 B1 * 11/2010 Dorsch et al. ..... 241/46.017
2009/0067992 A1 * 3/2009 Keener ..... 415/121.1
2010/0092276 A1 * 4/2010 Cartwright et al. ..... 415/121.1
2010/0266430 A1 * 10/2010 Shimizu ..... 417/423.8

OTHER PUBLICATIONS

Drawing of "A Series Cutter Assembly: Drawing #046897" to Homa, Feb. 2008.*

* cited by examiner

*Primary Examiner* — Christopher Verdier
*Assistant Examiner* — Aaron R Eastman
(74) *Attorney, Agent, or Firm* — Caesar Rivise, PC

(57) ABSTRACT

A centrifugal pump with a cutter mechanism consisting of a toothed cutter rotor, integral with the impeller wear ring, affixed to the impeller and a toothed cutter stator affixed to the casing, separately from the casing wear ring. A cutter mechanism consisting of a stator and rotor set such that they may be installed on the centrifugal pump impeller and casing as original equipment or as a retrofit. A cutter mechanism such that when installed in a centrifugal pump they prevent stringy materials, garbage and other agglomerated soft wastewater solids from partially restricting or totally blocking the inlet to the pump impeller. A cutter mechanism such that when it prevents solids from restricting or blocking the impeller inlet, it does so without significant decrease of flow throughput or significant increase in absorbed hydraulic horsepower.

18 Claims, 9 Drawing Sheets

CUTTER APPARATUS FOR CENTRIFUGAL PUMP

BACKGROUND OF THE INVENTION

1. Field of Invention

This invention relates generally to pumps for liquids, and more particularly, to centrifugal pump cutters for cutting solids suspended in the liquid.

2. Description of Related Art

Pumps in both the manure slurry and municipal waste markets are subject to clogging due to the nature of stringy materials and other soft solids which tend to restrict or block the impeller passages in a centrifugal pump. This clogging can occur as often as every few days.

One attempt to solve the clogging problem was provided by a drawing of an "A Series Cutter Assembly: Drawing #046897" to Homa. The Homa assembly is a crude welded device with a single slicer blade welded to a cutter plate, and two flat slicer blades welded inside an impeller and leaving a small opening therebetween. The Homa assembly has operational flaws, including shortcomings present in any welded device designed without thought to hydraulic impact of the cutters. For example, the Homa cutter and stator teeth block flow into the impeller, causing substantial pressure drop as flow enters the pump. This pressure drop will limit the amount of "lift" that the pumps can generate, limit the flow range of a pump, limit the size of a solid that can flow through the pump, and increase the amount of power that would be required to operate the pump. With just one impeller tooth the cutting force is skewed to one side causing life reducing unbalanced loads. The cutter teeth and impeller will have a reduced operational life because of the unbalance.

The Homa mechanism is fabricated with the teeth welded into the impeller and stator. Welding the teeth adds problem on operation of the pump. For example, welds can be attacked by corrosion causing premature failure. Heating from the welds can damage the impeller and stator. That is, the heat could warp the teeth and change the base structure of the underlying material. The corrosion resistance near the weld can change because of the heat. In addition, impact loads (from cutting) are concentrated at the weld points leading to reduced impeller/stator life. Further, the welded on teeth are non-replaceable. This means that failure at the weld would likely require a new impeller or plate in order to make a repair that now requires a pump rebuild. Even prior to failure, the welded-on teeth are wear items and will need to be renewed on a regular basis. Since pumps can go several years without a major rebuild, the requirement that base parts (impeller/stator) be replaced with the teeth is an expensive time consuming problem for pump users.

All references cited herein are incorporated herein by reference in their entireties.

BRIEF SUMMARY OF THE INVENTION

This summary is provided to introduce a selection of concepts in a simplified form that are further described below in the detailed description. This summary is not intended to identify essential features of the claimed subject matter, nor is it intended for use in determining the scope of the claimed subject matter.

According to an example of the invention, a cutter device for a centrifugal pump includes an impeller, a cutter ring, a wear ring and a stationary cutter plate. The impeller is concentrically located in a volute of the centrifugal pump. The volute has a front wall with a front flange defining an inlet port. The impeller has a rotational axis about which the impeller rotates within the volute. Further, the impeller has an inlet end that extends into and sits concentrically within the front flange. The cutter ring is releasably attached to the impeller, with the cutter ring concentric with the impeller and including a first set of teeth extending inwards towards the rotational axis of the impeller. The wear ring is located about the cutter ring between the cutter ring and the volute. The stationary cutter plate is releasably attached to the volute, concentric with and adjacent to the cutter ring. The stationary cutter plate includes a plate ring and a second set of teeth extending inwards from the plate ring towards the rotational axis of the impeller. The second set of teeth is in shearing communication with the first set of teeth to shear apart solids in the inlet port of the volute.

According to another example of the invention, a centrifugal pump includes a volute, an impeller, a cutter ring, a wear ring and a stationary cutter plate. The volute has a front wall with a front flange defining an inlet port. The impeller is concentrically located in the volute, with the impeller having a rotational axis about which the impeller rotates within the volute, and the impeller having an inlet end that extends into and sits concentrically within the front flange. The cutter ring is releasably attached to the impeller, with the cutter ring concentric with the impeller and including a first set of teeth extending inwards towards the rotational axis of the impeller. The wear ring is located about the cutter ring between the cutter ring and the volute. The stationary cutter plate is releasably attached to the volute, concentric with and adjacent to the cutter ring, with the stationary cutter plate including a plate ring and a second set of teeth extending inwards from the plate ring towards the rotational axis of the impeller. The second set of teeth is in shearing communication with the first set of teeth to shear apart solids in the inlet port of the volute.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

The examples of the invention shear apart solids in a centrifugal pump's suction inlet to prevent restriction or blockage in the impeller passages. The shearing action is accomplished by the mechanical interaction of a cutter ring fastened to the rotating impeller and a cutter plate fastened to the stationary volute of the centrifugal pump. The action of the cutter mechanism disrupts the formation of the clogging action and keeps flow moving through the pump. Some elements of the exemplary embodiments may include: profiled cutter teeth to optimize flow and Net Positive Suction Head (NPSH) characteristics, adjustable cutter clearances to maintain optimal shearing action, keyed engagement that takes impact away from the fasteners on a rotating cutter ring and stationary cutter plate. Further, the exemplary embodiments may be retrofitable to current solids handling pumps.

The exemplary embodiments include cutter and stator teeth that minimize clogging of the impeller passages into the pump. The size of the teeth/cutters is large enough to interrupt clogging, yet small enough to not restrict the original solids capacity of the centrifugal pumps. For example, the teeth project radially inwards preferably less than one-fourth of the diameter of the inlet to the impeller. The teeth are also structured with a hydraulic profile that matches the inlet angle of the impeller vanes. In this manner, each pump preferably has its own cutters designed to match the impeller inlet vane angles. That is, the teeth/cutters may preferably be hydraulically profiled to match the impeller. They may even be clocked at installation—oriented such that the teeth minimize the interruption of the inlet flow path. Accordingly, the exemplary embodiments reduce the impact to suction lift and restricted flows experienced by known designs.

The cutter assembly is machined from a casting bolted in, adjustable and key driven. This provides numerous advantages. For example, installation is preferably symmetrical and retrofitable, leading to predictable mechanical and hydraulic results. Cast and machined parts are not subject to corrosion caused by welding. The impeller and suction case are machined to accept the rotor and stator. This eliminates potential damage caused by welding on the parts. As another of the advantages highlighted herein, the key drive spreads out the impact load. Teeth will not be as readily sheared off at the weld. Further, the wear parts are retrofitable. This will be an incredible benefit to scores of municipal wastewater pump stations that have flow interruptions because of clogging and will be able to quickly add cutters without changing pumps or increasing motor size. When the parts have worn and need to be renewed the impeller and suction piece will be undamaged. The customer will be able to quickly change out the rotor and stator without replacing a damaged impeller or suction piece.

Figure 1:
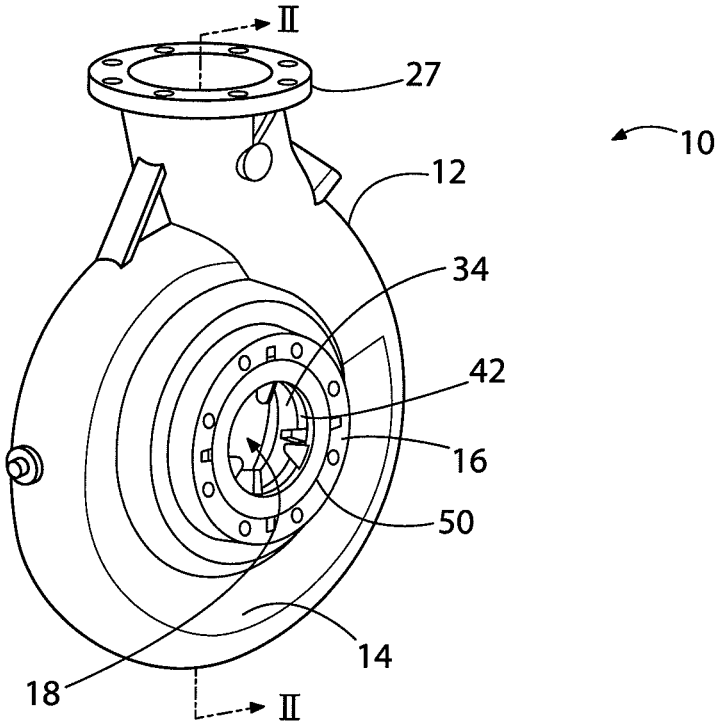
FIG. 1 is a perspective view of an exemplary cutter pump assembly in accordance with the preferred embodiments of the invention.
Figure 2:
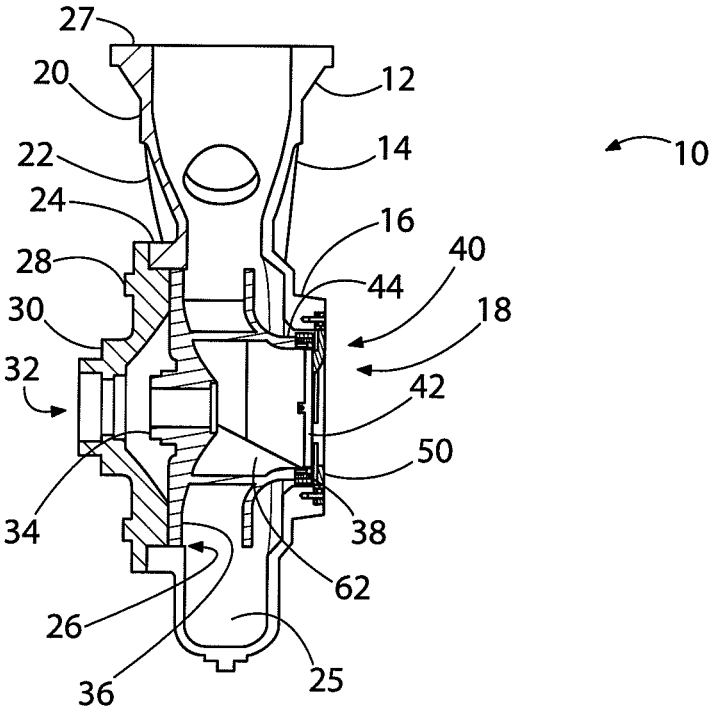
FIG. 2 is an axial sectional view of the exemplary cutter pump of FIG. 1.
Figure 3:
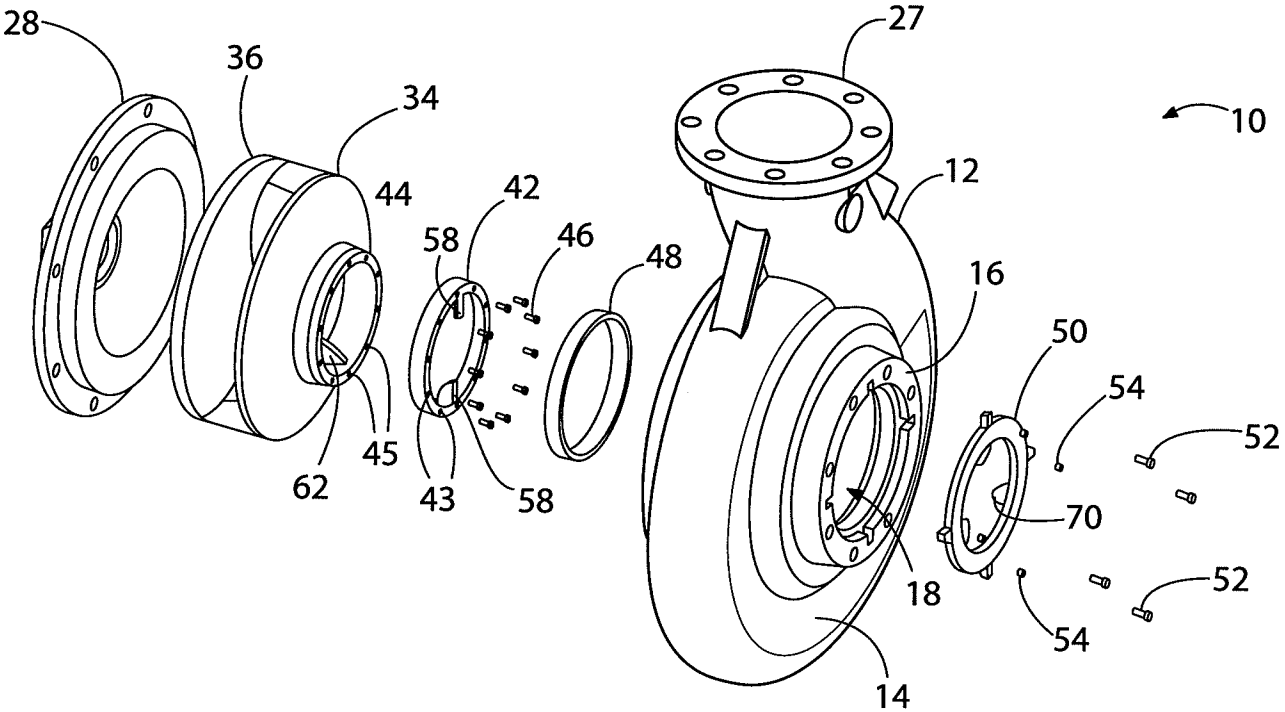
FIG. 3 is an isometric exploded assembly view of the exemplary cutter pump of FIG. 1.

Referring now in greater detail to the various figures of the application, wherein like-referenced characters refer to like parts, a general communication environment including an exemplary cutter pump assembly 10 of the invention is illustrated in FIG. 1. FIG. 2 depicts the cutter pump assembly 10 in axial cross view, and FIG. 3 depicts the cutter pump assembly in exploded view. With reference to FIGS. 1 and 2, shown therein in perspective view is a pump volute 12. The volute 12 has a front wall 14 with a front annular flange 16 defining an inlet port 18 and a rear wall 20 with a rear annular wall 22 and annular flange 24 defining a rear annular recess 26. The volute 12 defines a chamber 25 within scrolling out to a discharge flange 27. Other examples may encompass a wide range of different volute styles and shapes, as many aspects of the invention are not limited to use on centrifugal pumps. In fact, another example is depicted in FIGS. 8-11 and discussed in greater detail below. Typically the volute is made of iron, however, various other metals know in the art for increased hardness or corrosion resistances are acceptable as well. The volute is preferably cast and thus not subject to corrosion caused by welding.

Now referring to FIGS. 2 and 3, a backplate 28 is secured to the rear annular flange 24 of the volute 12 where it may be compressed between the volute and a motor assembly (not shown). The backplate 28 has an outward extending center section 30 with an annular recess cavity 32 into which a drive shaft of the motor extends. An impeller 34 concentrically sits in the volute 12 and includes a back wall 36 fitted in the rear annular recess within the annular wall 22 of the volute and rotatably against the backplate 28. The back wall 36 defines a bore 38 for attachment to the drive shaft of the motor. While not being limited to a particular theory, the impeller 34 is preferably closed vane as it consumes much less energy than open vane impellers. The impeller 34 includes a front wall 37 (FIG. 7) turned towards an inlet end 44 that extends into and sits concentrically within the front annular flange 16 and the wear ring 48. The inlet end 44 includes bolt fixing bores 45 and notches 47 (FIG. 6), which will be described in greater detail below. The impeller 34 is preferably machined from metal or a solid composition including metal. In use, the impeller 34 is rotated by a pump motor (not shown) to induce a pumping action as understood by a skilled artisan. The pumping action pulls slurry or pumpage into the inlet end 44, through the impeller 34 and out the volute flange 27.

A cutter assembly 40 is supported in or near the inlet port 18 defined by the front wall 14 and front annular flange 16 of the volute 12. As can be seen in FIGS. 4-7, the cutter assembly 40 includes a rotating cutter ring 42, preferably machined from a metal casting, which is retrofitably (e.g., releasably) attached to the inlet end 44 of the impeller 34 by cutter ring cap screws 46 threaded through bore walls 43 of the rotating cutter ring into the bolt fixing bores 45 of the impeller.

A wear ring 48 is disposed concentrically about the rotating cutter ring 42, and supported between abutting surfaces of the cutter ring and the front annular flange 16 of the front wall 14 (FIG. 3), where the wear ring can minimize friction and wear between the rotating cutter ring 42 and the stationary volute 12. The wear ring 48 may be a single piece of machined metal or other alloy composition. It is also understood that the wear ring 48 may be a bushing or other multi-piece annular unit.

The cutter assembly 40 also has an annular non-rotational, or stationary, cutter plate 50 retrofitably (e.g., releasably) attached to the front annular flange 16 of the volute 12 and adjacent the rotating cutter ring 42 by cutter plate cap screws 52 threaded through bore walls 76 of the stationary cutter plate into bolt fixing bores 78 of the front annular flange. Set screws 54 are threadingly disposed through the cutter plate 50 to adjust a clearance 56 between the rotating cutter ring 42 and the annular cutter plate 50 as described in greater detail below.

Figure 4:
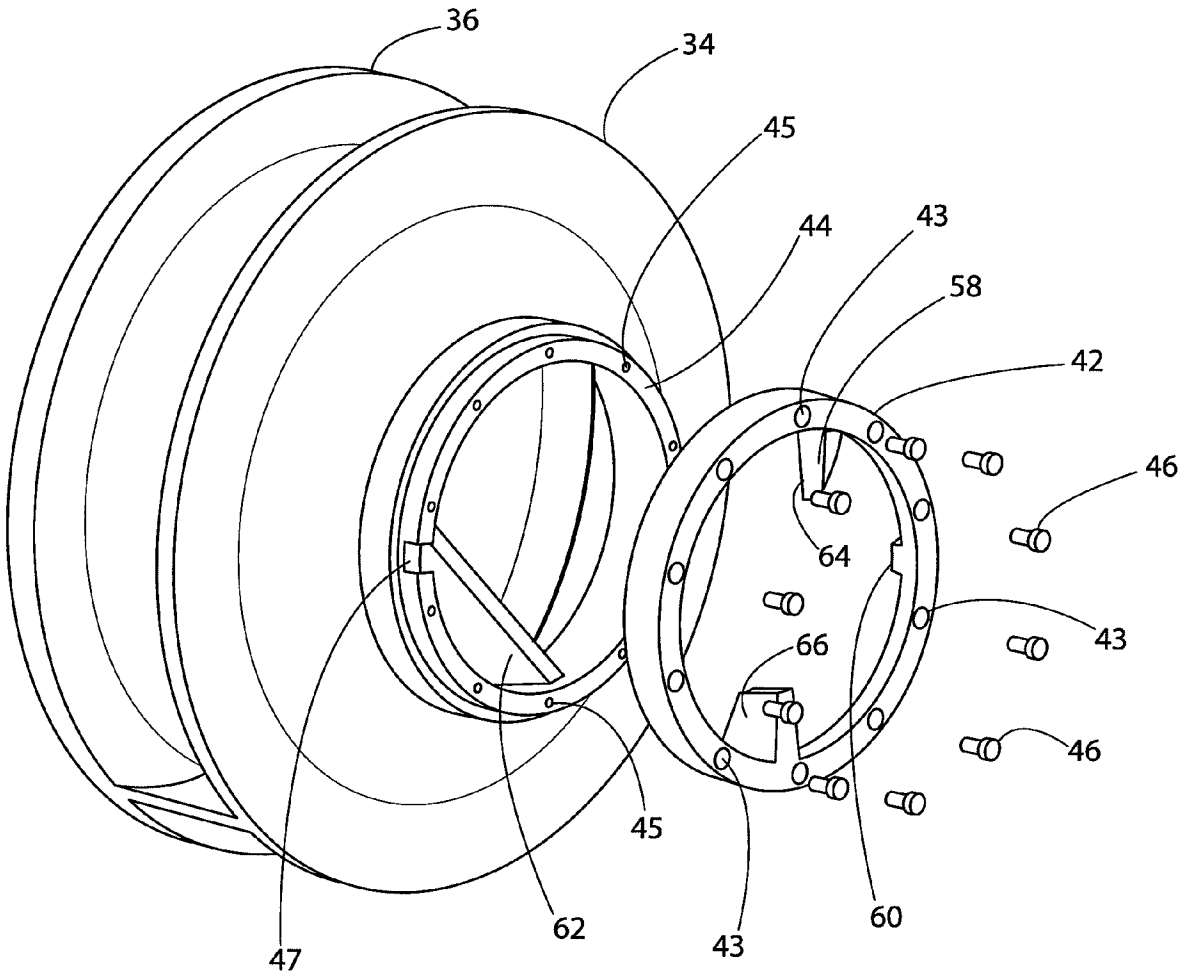
FIG. 4 is an enlarged isometric view of an impeller and rotating cutter ring assembly from the exemplary cutter pump of FIG. 1.

FIG. 4 depicts the impeller 34 and rotating cutter ring 42 enlarged from FIG. 3. While not being limited to a particular number, the rotating cutter ring 42 has two integrally formed profiled teeth 58 for cutting or shearing solids and two projections 60 that provide a keyed engagement with the impeller 34 as discussed in greater detail below. The profiled teeth 58 are machined from a casting with a hydraulic profile that matches an inlet angle of the impeller vanes 62. That is, the profiled teeth 58 have a cutting edge 64 and a blade 66 that is angled rearward from the cutting edge towards the impeller back wall 36 at an angle that matches the inlet angle of the impeller vanes 62. This matching hydraulic profile minimizes any impact to suction lift and restriction flow and minimizes pump efficiency loss. Preferably the profiled teeth 58 are oriented with the impeller vanes 62 to minimize the interruption of solids and slurry into the inlet flow path. While there is no limitation on the number of profile teeth 58, it is preferred that the rotating cutter ring 42 has at least two profiled teeth 58 equidistantly spaced about the rotating cutter ring to balance the impact load with the solids or slurry flowing through the impeller 34, which leads to a longer service life of the rotating cutter ring and the impeller.

Figure 6:
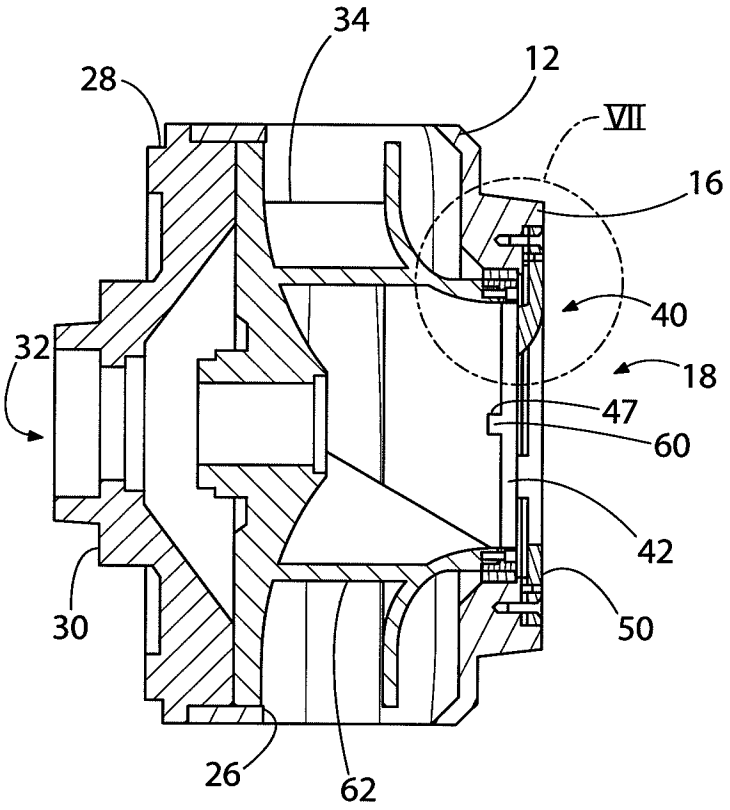
FIG. 6 is an enlarged axial sectional view of the exemplary cutter pump of FIG. 1 taken along line 6-6 of FIG. 5.
Figure 5:
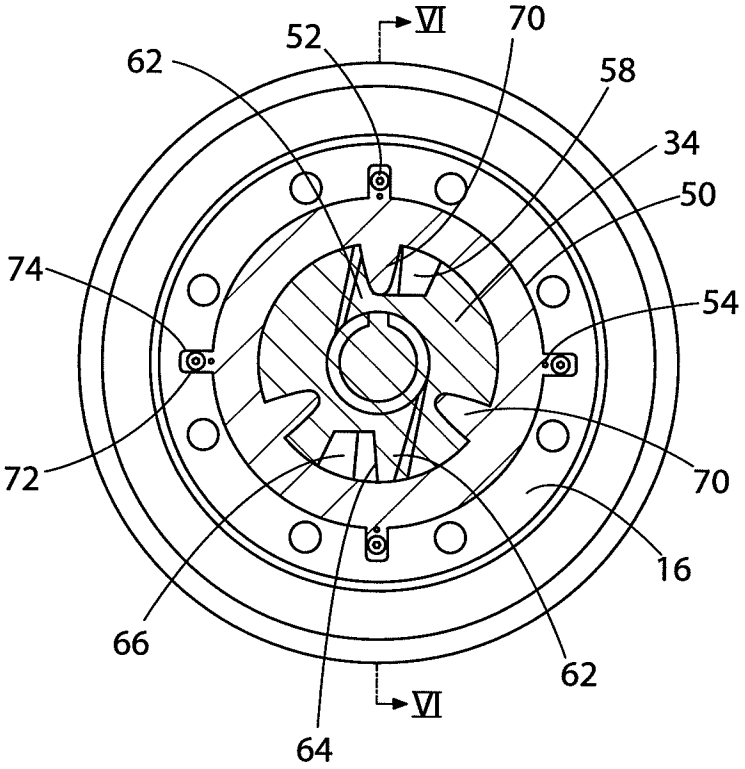
FIG. 5 is an enlarged partial front view of the exemplary cutter pump of FIG. 1.

FIGS. 5 and 6 depict the cutter pump assembly 10 in enlarged partial front view and enlarged axial sectional view, respectively. As can best be seen in FIG. 6, the projections 60 of the rotating cutter ring 42 are machined to fit into notches 47 at the inlet end 44 (FIG. 2) of the impeller 34. The projections 60 are sized to fit snuggly into the notches 47 in a keyed engagement and take impact away from the fasteners (e.g., cap screws 46 shown in FIG. 4) attaching the impeller 34 to the rotating cutter ring 42. Preferably the projections 60 and the notches 47 are squared to permit a snug fit and maximize the impact transfer, here from the cap screws 46, bolt fixing bores 45, and bore walls 43 (FIGS. 4 and 7), to the projections 60 and notches 47, and reduce impact damage and wear at the cap screws, bolt fixing bores and bore walls. While the exemplary embodiment shows two sets of matching notches 47 and projections 60, it is understood that the invention is not limited thereto and that any appropriate number of sets of matching notches 47 and projections 60 is within the scope of the invention. Preferably the number of sets is plural and spaced equidistantly about the impeller 34 and rotating cutter ring 42 to equally distribute the impacts.

Still referring to FIGS. 5 and 6, the stationary cutter plate 50 is attached to the front annular flange 16 of the volute 12 by cutter plate cap screws 52. The stationary cutter plate 50 is preferably machined from a metal casting with three integrally formed stationary teeth 70 provided to engage with the profiled teeth 58 of the rotating cutter ring 42 for cutting or shearing solids flowing into the inlet end 18 of the volute 12. The stationary teeth 70 are machined from a casting with a profile that allows entry of solids/slurry into the impeller 34 while extending into the inlet end far enough to match against the profiled teeth 58 for shearing action. The stationary teeth 70 each have a sharp edge closest to an approaching profiled tooth to maximize the cutting and shearing action there between. While there is no limitation on the number of stationary teeth 70, it is preferred that the rotating cutter ring 42 has a plurality of teeth, and most preferably one more or one less tooth in comparison to the number of profiled teeth 58. The stationary teeth 70 are equidistantly spaced about the stationary cutter plate 50 to balance the impact load with the solids or slurry flowing through the impeller 34 and to balance the shearing action between the stationary teeth and the profiled teeth, which leads to a longer service life of the stationary cutter plate and the rotating cutter ring 42.

Figure 7:
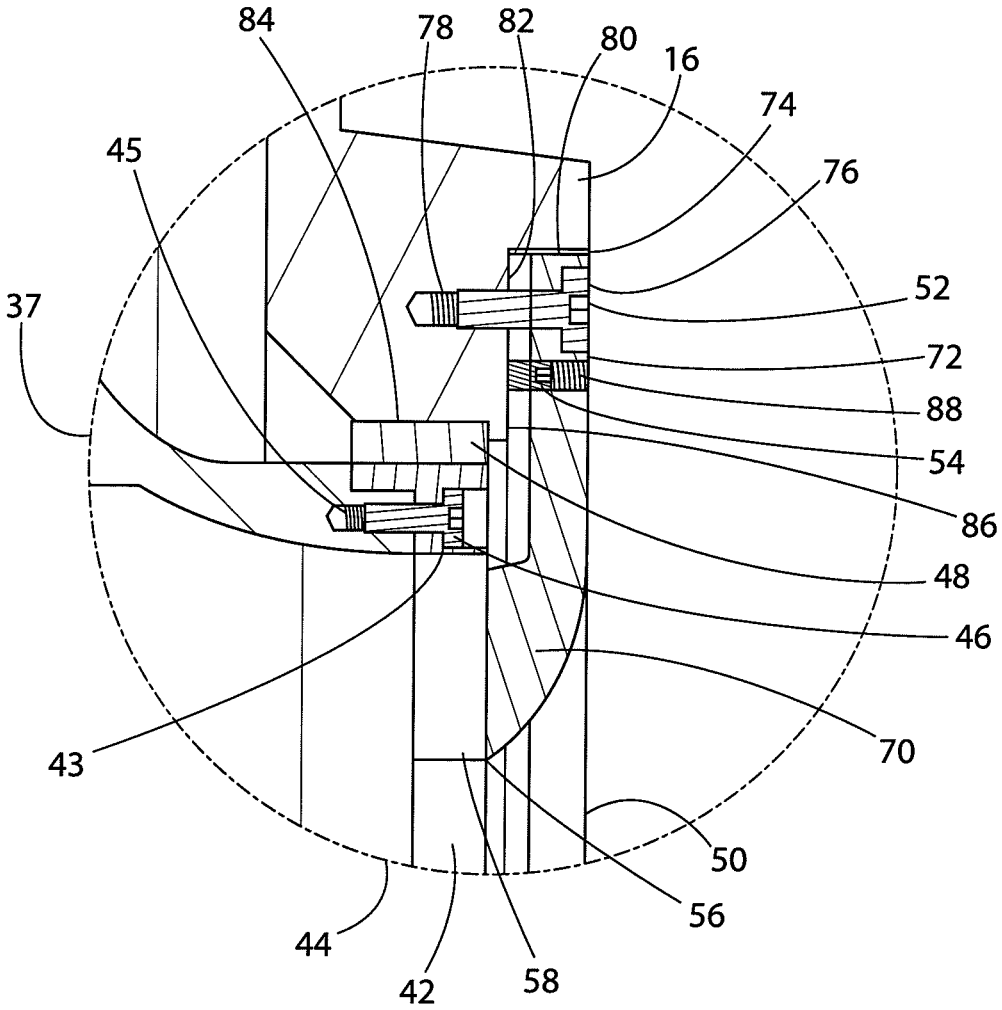
FIG. 7 is an enlarged detailed sectional view of the exemplary cutter pump depicted in FIG. 6
Figure 8:
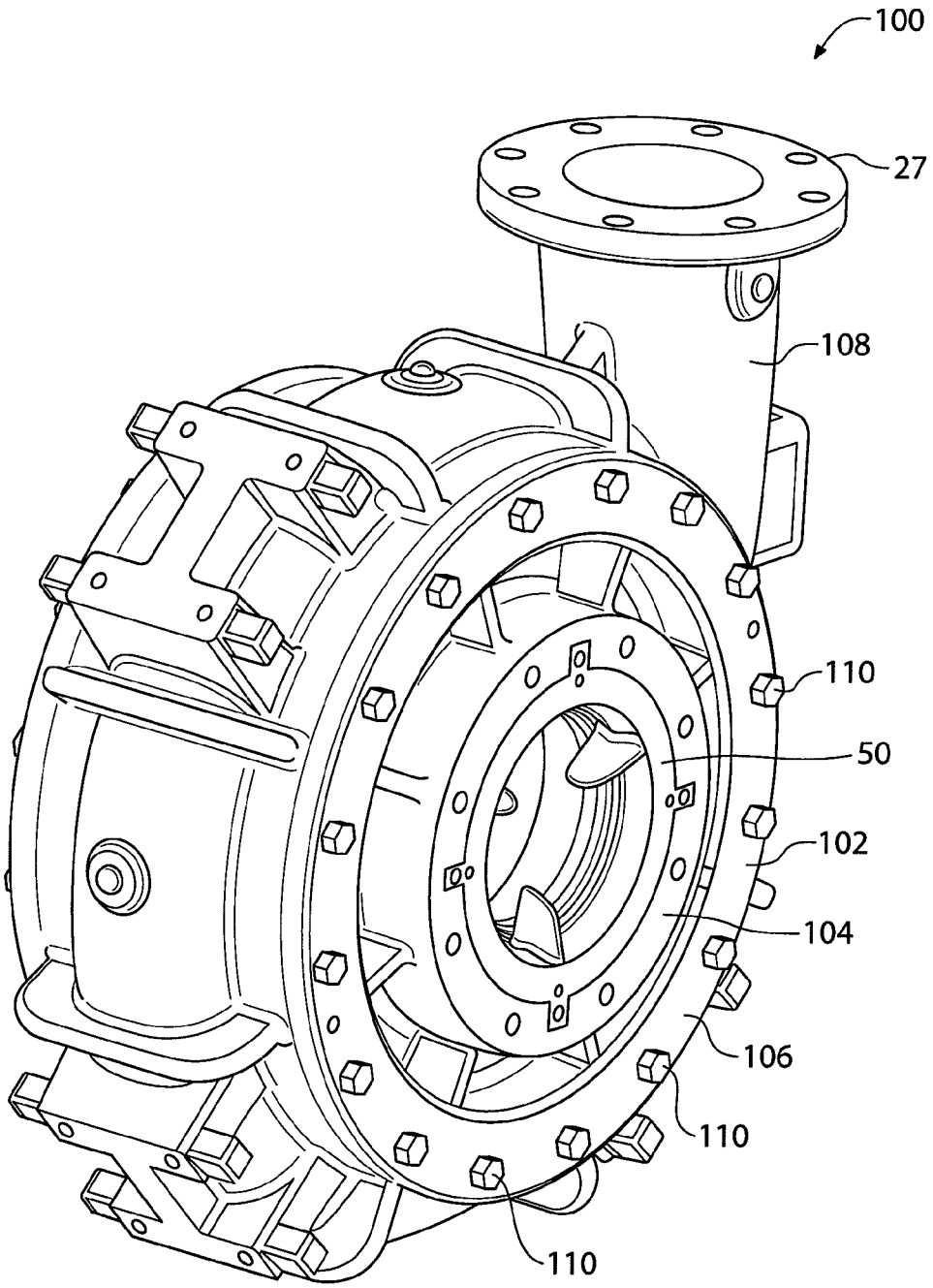
FIG. 8 is a perspective view of a second exemplary cutter pump assembly in accordance with the preferred embodiments of the invention.

The stationary cutter plate 50 also includes projections 72 extending radially outwards that are machined to fit into channels 74 at the front annular flange 16. The projections 72 include bore walls 76 (FIG. 7), and are sized to fit snuggly into the channels 74 in a keyed engagement and take impact away from the fasteners (e.g., cap screws 52) attaching the stationary cutter plate 50 to the front annular flange 16 via the bore walls 76 (FIG. 7). Preferably the projections 72 and the channels 74 are squared to permit a snug fit and maximize the impact transfer, here from the cap screws 52, bore walls 76 (FIG. 7), and bolt fixing bores 78 (FIG. 7), to the projections 72 and channels 74. While the exemplary embodiment shows four sets of matching projections 72 and channels 74, it is understood that the invention is not limited thereto and that any appropriate number of sets of matching projections and channels is within the scope of the invention. Preferably the number of sets is plural and spaced equidistantly about the front annular flange 16 and stationary cutter plate 50 to equally distribute the impacts.

As discussed above, the rotating cutter ring 42 and the stationary cutter plate 50 are retrofitable. That is, the rotating cutter ring 42 and the stationary cutter plate 50 are releasable with their respectively attached members (e.g., impeller 34, volute 12), here via the threaded cap screws 46, 52 (FIG. 7). This is beneficial since both of these members include wear parts (e.g., teeth) that wear out over time and generally quicker than the other parts of the cutter pump assembly 10. In the examples of the invention, as the teeth of the rotating cutter ring 42 and stationary cutter plate 50 become dull, break, or wear down, the used rotating cutter ring and stationary cutter plate can be removed and replaced with a new or refurbished cutter ring or plate having sharp teeth effective for shearing the slurry. This extends the life of, for example, the impeller 34, which has a longer service live than a rotating cutter ring 42, because a plurality of rotating cutter rings may be retrofitted and used with the impeller. This also adds flexibility to the cutter pump assembly 10 as differently configured rotating rings can be used with the assembly based on which configuration (e.g., number of teeth, angle of teeth blades, and size of teeth) may be preferred for a specific slurry, suction level, or output.

FIG. 7 is an enlarged detailed sectional view showing interaction between the volute 12 (FIG. 1), the stationary cutter plate 50, the rotating cuter ring 42, the wear ring 48 and the impeller 34 (FIG. 1). Preferably the front annular flange 16 includes an outer annular wall 80, a recessed planar wall 82, an inner annular wall 84, and an annular projection rim 86. In this example the wear ring 48 is dimensioned to be supported in and axially aligned with the inner annular wall 84 against the annular projection rim 86. Similarly the stationary cutter plate 50 is dimensioned to be supported in and axially aligned with the outer annular wall 80 and parallel to the recessed planar wall 82. As discussed above, the front annular flange 16 also includes the bolt fixing bores 78 for receiving the cutter plate cap screws 52.

As can best be seen in FIG. 7, the set screws 54 are threadingly disposed through threaded bores 88 in the stationary cutter plate 50 to adjust a clearance 56 between the rotating cutter ring 42 and the stationary cutter plate 50. In particular, the set screws 54 are threaded through the threaded bores 88 into abutment against the recessed planar wall 82 to spatially set the stationary cutter plate 50 at a distance from the recessed planar wall as the stationary cutter plate is attached to the front annular flange 16 via the cap screws 52 threaded into the bolt fixing bores 78. The set screws 54 are adapted to set the distance between the stationary cutter plate 50 and the recessed planar wall 82 to provide a clearance 56 between the stationary teeth 70 and the profiled teeth 58 of the rotating cutter ring 42 to allow a shearing interaction in use therebetween when the profiled teeth 58 are rotated adjacent the stationary teeth. Preferably this clearance is set to between 0.01 and 0.02 inches. While the exemplary embodiment shows four set screws, it is understood that the invention is not limited thereto and that any number of set screws is within the scope of the invention. Preferably the number of set screws 54 is plural and spaced equidistantly about stationary cutter plate 50 to provide equal clearance between the stationary teeth 70 and the profiled teeth 58.

During pump operation, the slurry or pumpage, including suspended solids and stringy materials, enters thru the inlet port 18 of the pump volute 12, as shown in FIGS. 1, 2, 3 and 6. The slurry then is drawn into the cutter assembly 40 by the pumping action of the impeller 34. The slurry passes between the stationary cutter plate 50 and the rotating cutter ring 42, at which point the suspended solids are sheared into smaller segments. The sheared pumpage then flows through the impeller 34 and is discharged out into the volute chamber 25 and exits the volute 12 through the discharge flange 27.

FIGS. 8-11 depict a second example of a cutter pump assembly 100 that is substantially similar to the cutter pump assembly 10 in structure and operation. As discussed above, the cutter pump assembly 10 has an integral suction arrangement where the suction area of the front wall 14 and front annular flange 16 are part of the pump volute 12 casting. However, the cutter pump assembly 100 depicted in FIGS. 8-11 has a structural arrangement with a detachable front wall 102 and front annular flange 104 cast as a separate suction cover 106 that is attached to the volute 108 via suction cover bolts 110 preferably threaded into matching bores 112 of the volute. Thus the suction cover 106 may be considered as an example of a detachable front wall of the volute 108.

The cutter pump assembly 100 includes a back cover 114 that may be secured to the volute 108 via bolts 110 preferably threaded into matching bores 112 of the volute 108. The back cover 114 is larger in proportion to the volute 108 than the back plate 28 of the first exemplary cutter pump assembly 10 discussed above, with the back cover 114 including a rear wall 116.

Figure 9:
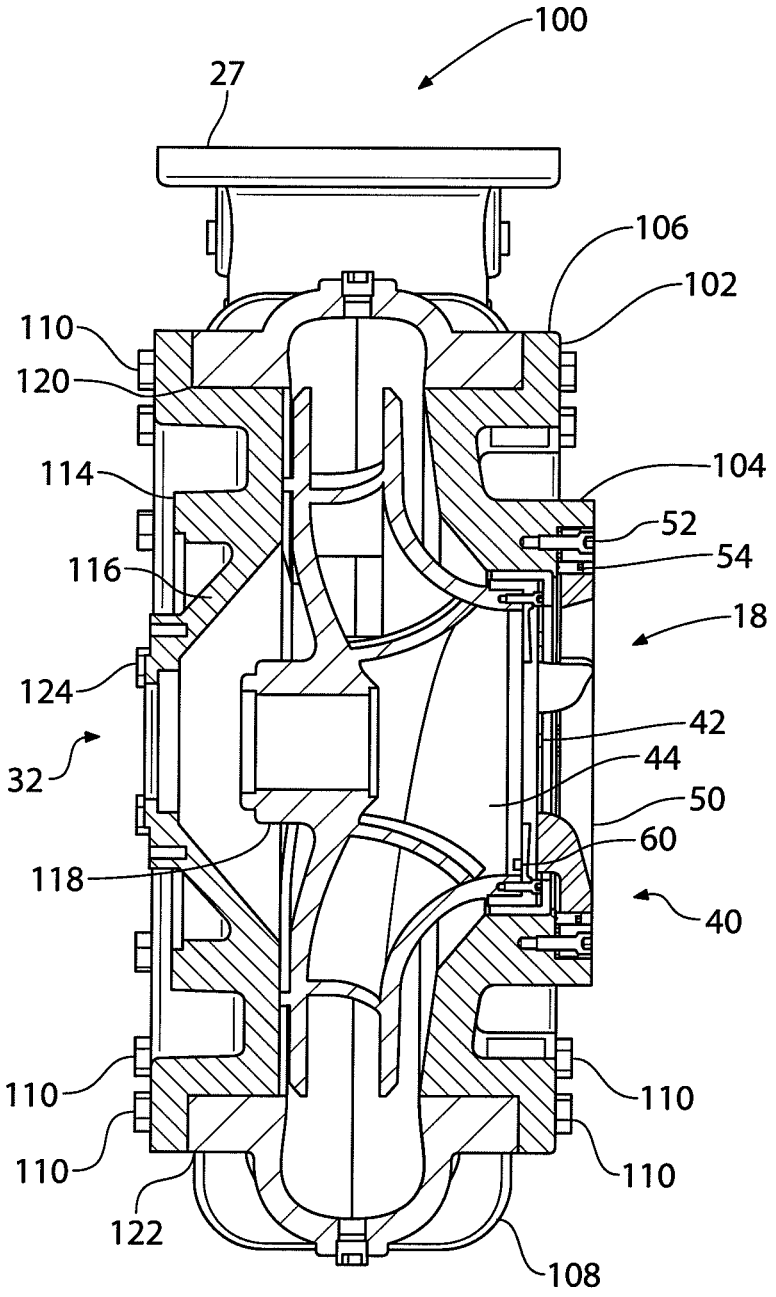
FIG. 9 is an axial sectional view of the exemplary cutter pump of FIG. 8.
Figure 10:
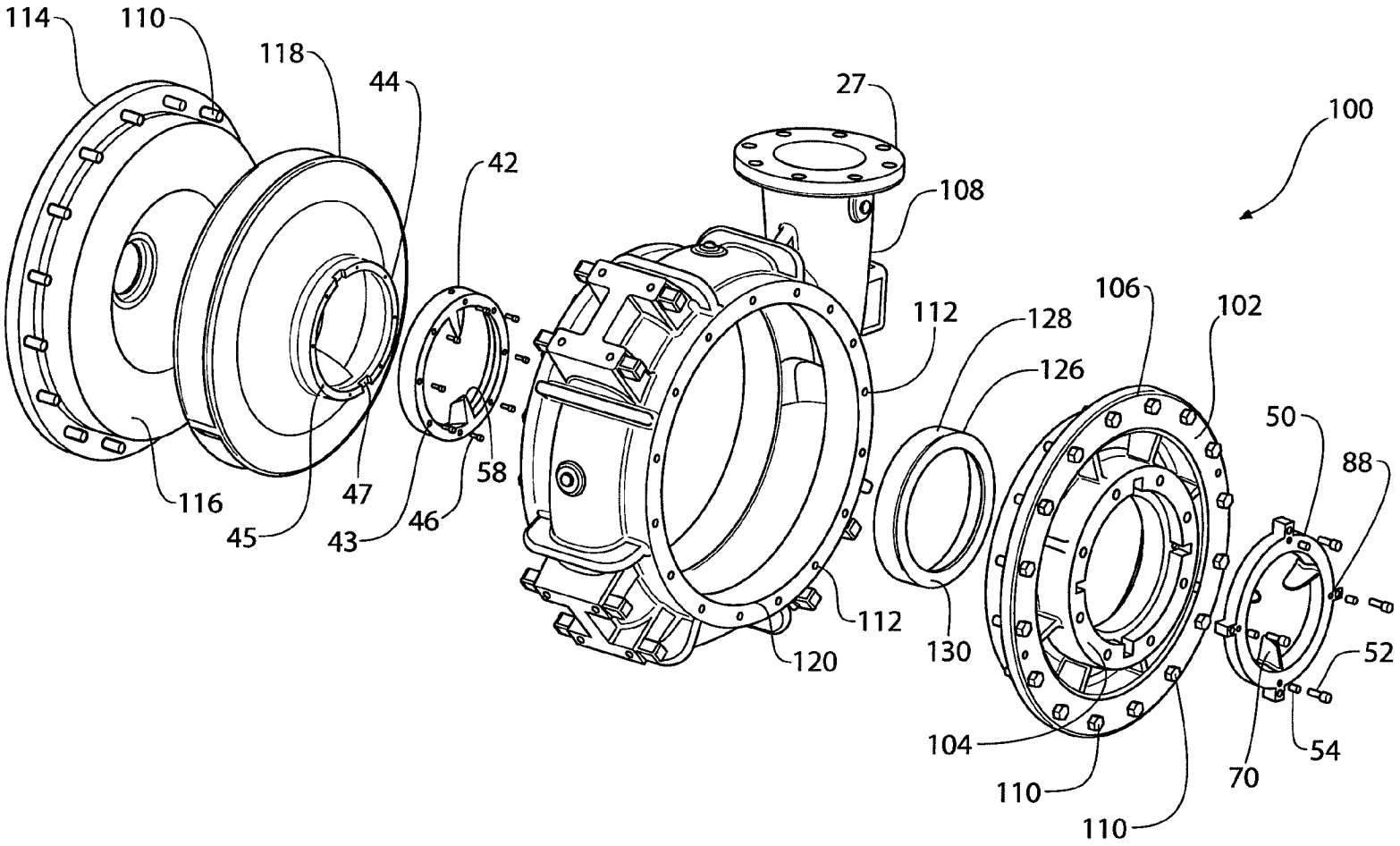
FIG. 10 is an isometric exploded assembly view of the exemplary cutter pump of FIG. 8.

As can be seen in FIGS. 9 and 10, the back cover 114 is securable to a rear rim 122 of the volute 108 where it may be compressed between the volute and a motor assembly (not shown). The back cover 114 has an outward extending center section 124 with an annular recess cavity 32 into which a drive shaft of a motor may extend. The impeller 118 concentrically sits in the volute 108 rotatably against the back cover 114. Like the impeller 34 discussed above, the impeller 118 is also preferably closed vane as it consumes much less energy than open vane impellers. The impeller 118 also includes an inlet end 44 that extends into and sits concentrically within the front annular flange 104 and the wear ring 126. The inlet end 44 includes bolt fixing bores 45 and notches 47 as discussed above with reference to FIGS. 2, 3, 6 and 7. The impeller 118 may also be preferably machined from a metal or a solid compositing including metal. Like the impeller 34, the impeller 118 may be rotated by a pump motor (not shown) to induce a pumping action that pulls slurry or pumpage into the inlet end 44, through the impeller 118 and out the volute flange 27.

The cutter pump assembly 100 also includes a cutter assembly 40 supported adjacent the inlet port 18 defined by the front annular flange 104 of the suction cover 106. As discussed in greater detail above, the cutter assembly 40 includes the rotating cutter ring 42, a wear ring 126, and the stationary cutter plate 50. The rotating cutter ring 42 may be retrofitably attached to the inlet end 44 of the impeller 118 by cutter ring cap screws 46 threaded through bore walls 43 of the rotating cutter ring and into the bolt fixing bores 45 of the impeller, as also discussed above.

Figure 11:
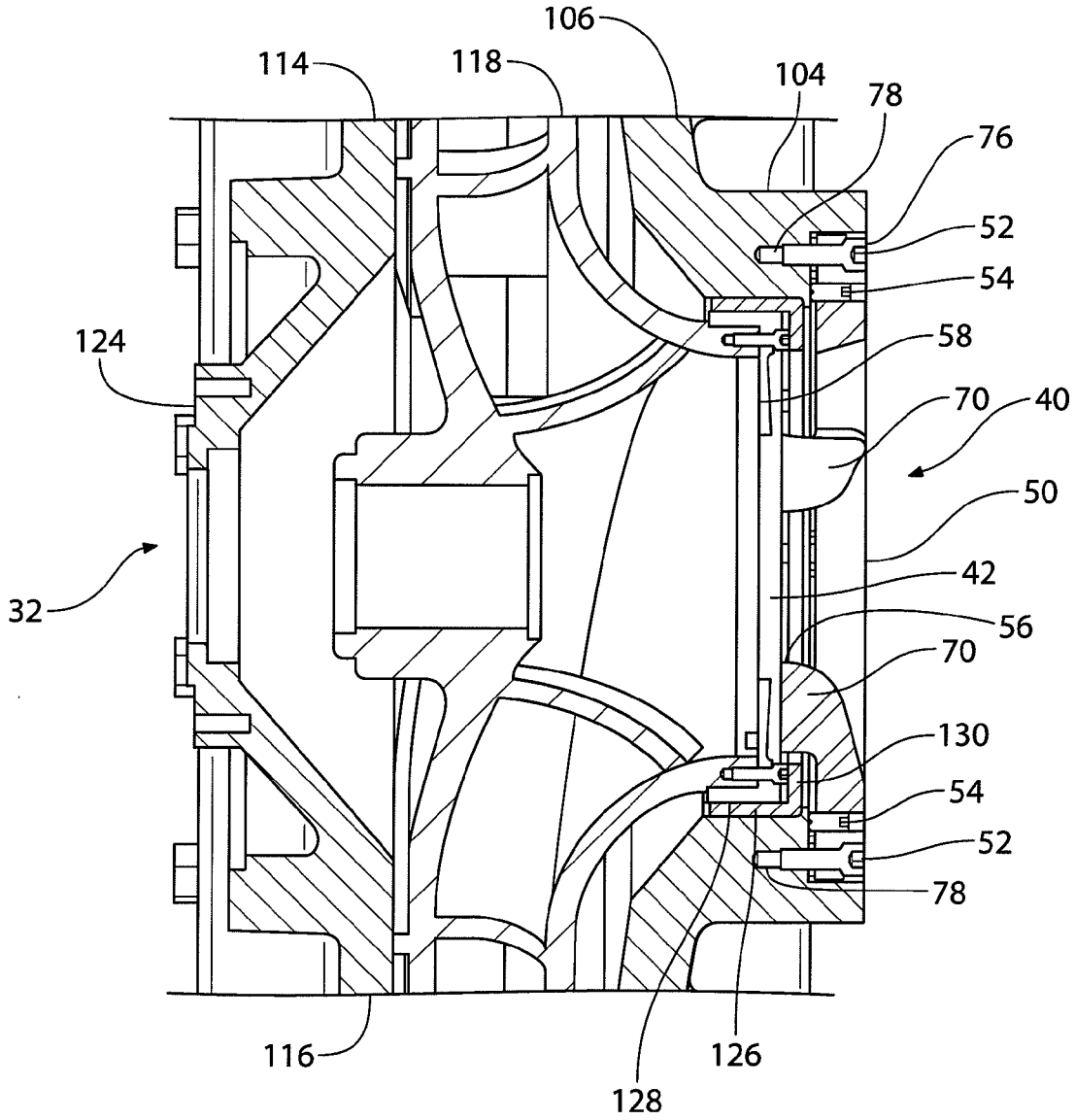
FIG. 11 is an enlarged axial sectional view of the exemplary cutter pump of FIG. 8.

The wear ring 126 is disposed concentrically about the rotating cutter ring 42, and supported between abutting surfaces of the cutter ring, the front annular flange 104 and the cutter plate 50. In cross section, the wear ring 126 can be seen as generally L-shaped with a longitudinally extending portion 128 and a radially extending portion 130 (FIG. 11). In this configuration, the wear ring 126 can minimize friction and wear between the rotating cutter ring 42, the cutter ring cap screws 46 and the front annular flange 104 of the suction cover 106. Similar to the wear ring 48 discussed above, the wear ring 126 may be a single piece of machined metal or other alloy composition. Of course it is understood that the wear ring 126 may be a bushing or other multi-piece annular unit.

The cutter plate 50 of the cutter assembly 40 depicted in FIGS. 9-11 is retrofitably (e.g., releasably) attached to the front annular flange 104 of the suction cover 106 by cutter plate cap screws 52 threaded through bore walls 76 of the stationary cutter plate into bolt fixing bores 78 of the front annular flange. As discussed above, set screws 54 are threadingly disposed through the cutter plate 50 to adjust the clearance 56 between the profile teeth 58 of the rotating cutter ring 42 and the stationary teeth 70 of the annular cutter plate 50 (FIG. 11). Accordingly, as would readily be understood by a skilled artisan, the primary difference between the cutter pump assembly 10 shown by example in FIGS. 1-7 and the cutter pump assembly 100 shown by example in FIGS. 8-11 include the separate suction cover 106 as a detachable front wall that is bolted to the volute 108, the cutter plate 50 being coupled to the front annular flange 104 of the suction cover, the larger impeller 118, and the larger back cover 114.

The operation of the cutter pump assemblies 10, 100 are substantially the same. For example, during pump operation of the cutter pump assembly 100, the slurry or pumpage enters through the inlet port 18, is drawn into the cutter assembly 40 by the pumping action of the impeller 118 is sheared into smaller segments as it passes between the stationary cutter plate 50 and the rotating cutter ring 42, flows through the impeller 118 and is discharged out into the volute chamber and exits the volute through the discharge flange 27.

It is understood that the cutter apparatus for a centrifugal pump described and shown are exemplary indications of preferred embodiments of the invention, and are given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof. For example, the number, location and shape of the teeth, projections, notches and channels described may be altered without departing from the scope of the invention. Without further elaboration the foregoing will so fully illustrate the invention that others may, by applying current or future knowledge, readily adapt the same for use under various conditions of service.

What is claimed is:

1. A cutter device for a centrifugal pump, comprising:

an impeller concentrically located in a volute of the centrifugal pump, the volute having a front wall with a front annular flange defining an inlet port, said impeller having a rotational axis about which said impeller rotates within the volute, said impeller having an inlet end that extends into and sits concentrically within the front annular flange, said inlet end including a notch;

a cutter ring releasably attached to said impeller, said cutter ring concentric with said impeller and including a first set of teeth extending inwards towards the rotational axis of said impeller, said cutter ring including a projection machined to fit into said notch as a keyed engagement between said cutter ring and said impeller;

a wear ring about said cutter ring between said cutter ring and the volute;

a stationary cutter plate releasably attached to the volute, concentric with and adjacent to said cutter ring, said stationary cutter plate including a plate ring and including a second set of teeth having at least one tooth extending inwards from the plate ring towards the rotational axis of said impeller, said second set of teeth being in shearing communication with said first set of teeth to shear apart solids in the inlet port of the volute.

2. The cutter device of claim 1, said impeller including an impeller vane having an inlet angle, said first set of teeth each having a cutting edge and a blade angled from the cutting edge to match the inlet angle of the impeller vane.

3. The cutter device of claim 1, said inlet end of said impeller being annular with a diameter, wherein said first set of teeth project radially inwards less than one-fourth of the diameter of said inlet end.

4. The cutter device of claim 1, wherein said impeller is a closed vane impeller.

5. The cutter device of claim 1, further comprising a back plate in communication with said impeller to secure said impeller within the volute.

6. The cutter device of claim 1, wherein said front wall is detachable.

7. The cutter device of claim 1, wherein the first set of teeth includes at least two teeth equidistantly spaced about the cutter ring.

8. The cutter device of claim 1, wherein there are at least two sets of a matching notch and projection spaced equidistantly about the impeller and the cutter ring.

9. The cutter device of claim 1, wherein the second set of teeth includes at least two teeth equidistantly spaced about the stationary cutter plate.

10. A centrifugal pump, comprising:

a volute having a front wall with a front annular flange defining an inlet port;

an impeller concentrically located in said volute, said impeller having a rotational axis about which said impeller rotates within said volute, said impeller having an inlet end that extends into and sits concentrically within said front annular flange, said inlet end including a notch;

a cutter ring releasably attached to said impeller, said cutter ring concentric with said impeller and including a first set of teeth extending inwards towards the rotational axis of said impeller, said cutter ring including a projection machined to fit into said notch as a keyed engagement between said cutter ring and said impeller;

a wear ring about said cutter ring between said cutter ring and said volute;

a stationary cutter plate releasably attached to said volute, concentric with and adjacent to said cutter ring, said stationary cutter plate including a plate ring and including a second set of teeth having at least one tooth extending inwards from the plate ring towards the rotational axis of said impeller, said second set of teeth being in shearing communication with said first set of teeth to shear apart solids in said inlet port of said volute.

11. The centrifugal pump of claim 10, said impeller including an impeller vane having an inlet angle, said first set of teeth each having a cutting edge and a blade angled from the cutting edge to match the inlet angle of said impeller vane.

12. The centrifugal pump of claim 10, said inlet end of said impeller being annular with a diameter, wherein said first set of teeth project radially inwards less than one-fourth of the diameter of said inlet end.

13. The centrifugal pump of claim 10, wherein said impeller is a closed vane impeller.

14. The centrifugal pump of claim 10, further comprising a back plate in communication with said impeller to secure said impeller within said volute.

15. The cutter device of claim 10, wherein said front wall is detachable.

16. The centrifugal pump of claim 10, wherein the first set of teeth includes at least two teeth equidistantly spaced about the cutter ring.

17. The centrifugal pump of claim 10, wherein there are at least two sets of a matching notch and projection spaced equidistantly about the impeller and the cutter ring.

18. The centrifugal pump of claim 10, wherein the second set of teeth includes at least two teeth equidistantly spaced about the stationary cutter plate.

* * * * *